United States Patent [19]

Sashihara et al.

[11] 4,021,250

[45] May 3, 1977

[54] THERMALLY DEVELOPABLE PHOTOSENSITIVE MATERIAL

[75] Inventors: Kenji Sashihara; Takao Masuda; Hiroshi Yamashita; Yasuhiro Noguchi, all of Asaka, Japan

[73] Assignee: Fuji Photo Film Co., Ltd., Minami-ashigara, Japan

[22] Filed: Oct. 1, 1974

[21] Appl. No.: 510,970

[30] Foreign Application Priority Data

Oct. 1, 1973 Japan ..... 48-110287

[52] U.S. Cl. ..... 96/114.1; 96/95; 96/109

[51] Int. Cl.[2] ..... G03C 1/02; G03C 1/06; G03C 1/34

[58] Field of Search ..... 96/114.1, 109, 114.6, 96/114.7, 114.8, 114, 95

[56] References Cited

UNITED STATES PATENTS

| | | | |
|---|---|---|---|
| 2,981,738 | 4/1961 | Kranz | 260/308 B |
| 3,413,138 | 11/1968 | Georgalas et al. | 428/512 |
| 3,531,286 | 9/1970 | Renfrew | 96/114.1 |
| 3,764,328 | 10/1973 | Birkeland | 96/114.1 |

*Primary Examiner*—Edward C. Kimlin
*Assistant Examiner*—L. Falasco
*Attorney, Agent, or Firm*—Sughrue, Rothwell, Mion, Zinn & Macpeak

[57] ABSTRACT

A thermally developable photosensitive material comprising a support having thereon in one or more layers, (a) an organic silver salt, (b) a catalytic amount of a photosensitive silver halide or a compound capable of forming photosensitive silver halide, (c) a reducing agent, (d) a binder and (e) at least one compound represented by the following general formula (I), (I)

wherein $R_1$ and $R_2$ each is an alkyl group or an aralkyl group; and $R_3$ is a hydrogen atom, an alkyl group, a chloroanilino group, a benzyloxy group, a 2-oxo-1-(N-phenylcarbamoyl)propyl group or a substituted phenyl group having one or more of a chlorine atom, an alkyl group, an amino group, an alkylamino group and a dialkylamino group as substituents; the following general formula (II), wherein $R_4$ is a group, a group or a $-NH(CH_2)_n-NH-$ group; and $n$ is an integer of 1 to 5; or the following general formula (III), wherein $R_5$ is an aryl group, a 3-pyridyl group or a 2-thienyl group, and X is —S—, —O— or —NH—.

10 Claims, 1 Drawing Figure

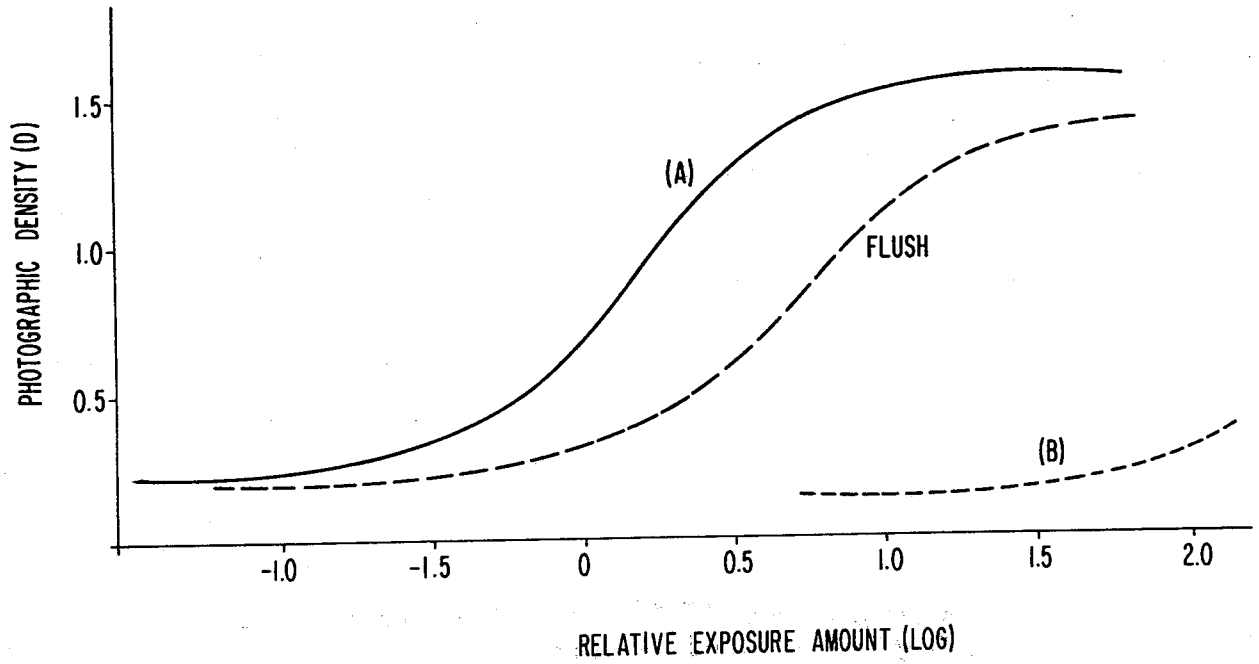
PHOTOGRAPHIC DENSITY (D)
1.5
1.0
0.5
-1.0
-1.5
0
0.5
1.0
1.5
2.0
RELATIVE EXPOSURE AMOUNT (LOG)
(A)
FLUSH
(B)

THERMALLY DEVELOPABLE PHOTOSENSITIVE MATERIAL

BACKGROUND OF THE INVENTION

1. Field of the Invention

The present invention relates to a thermally developable photosensitive material, and more particularly relates to a thermally developable photosensitive material containing a compound which protects it from deterioration on storage prior to exposure.

2. Description of the Prior Art

Photographic methods employing a silver halide have been widely employed because the photographic properties such as sensitivity or gradation are better than those of electrophotographic methods and diazo photographic method. However, a silver halide photosensitive material employed in photographic methods must be developed, after exposure, with a developer, followed by stopping, fixing, washing and stabilizing so that the developed images do not change in color or do not fade under light, and so that the undeveloped portions thereof (hereinafter, referred to as "background") do not blacken. Accordingly, these processings are laborious and time consuming, and the handling of chemicals is often hazardous and the operators' hands and clothes are stained. It has been, therefore, desired in photographic methods employing silver halide that dry processings can be carried out without the necessity for processing in solution yet to maintain the processed images stable.

Various methods have been proposed to accomplish this. One method is a thermally developable photosensitive material disclosed in U.S. Pat. Nos. 3,152,904, 3,457,075, 3,635,719, 3,645,739 and 3,756,829, and Canadian Pat. No. 811,677.

In these materials, a silver salt of a long-chain aliphatic carboxylic acid, for example, silver behenate, or silver saccharin, silver benzotriazole, etc. as a light-sensitive element, and a catalytic amount of silver halide are used.

The present invention relates to these types of thermally developable photosensitive materials.

If conventional thermally developable photosensitive materials are stored in the dark, they are desensitized or fogged. The term "fog" is used to describe the phenomenon in which the unexposed portions of the thermally developable photosensitive materials are blackened by thermal development; The tendency toward fog formation upon subsequent development increases after storage of conventional thermally developable photosensitive materials since fogging nuclei are formed. That is, their shelf life is insufficient. As used in this specification, the term "good shelf life" means that the photographic properties of photosensitive materials in storage are the same as or similar to the photographic properties obtained directly after the preparation of the photosensitive materials.

As disclosed in Japanese Patent Application Laid open to Public Inspection No. 125016/1974 and 29463/74, corresponding to U.S. Application No. 558,607 filed Mar. 14, 1975, it has been recognized that acids prevent the generation of fogging nuclei during storage which results in an increase of fog when the thermally developable material is thermally developed. While in regard to the phenomenon observed, when the thermally developable material is thermal developed after long storage, that the image density does not increase and the sensitivity of the material is gradually reduced, it has been assumed that the oxidation of the reducing agent by oxygen in the air during storage causes this phenomenon.

In order to improve the shelf life, various methods have been proposed. One method involves preventing the reducing agent from being oxidized by oxygen in the atmosphere by incorporating an oxidizing agent in the photosensitive or layer or by providing a polymer layer on the photosensitive layer. Another method involves the replacement of phenols or naphthols as a reducing agent by bisphenols as disclosed in Japanese Patent Application No. 81,625/73, corresponding to U.S. Application No. 489,327, filed July 17, 1974, now abandoned. or by bisnaphthols as disclosed in Japanese Patent Application Laid Open to Public Inspection No. 6,074/71. However, no method by which the shelf life is remarkably improved has been developed.

SUMMARY OF THE INVENTION

Therefore, an object of the invention is to provide a thermally developable photosensitive material employing an oxidizing agent for a silver salt, particularly, a silver fatty acid.

Another object of the invention is to provide a thermally developable photosensitive material having improved shelf life.

As the results of various research to attain the above objects of the invention, the following compounds have been found to be effective. That is, the thermally developable photosensitive material of the invention comprises a support having thereon a layer or layers containing (a) an organic silver salt, (b) a catalytic amount of a photosensitive silver halide or a compound capable of forming a photosensitive silver halide, (c) a reducing agent, (d) a binder and (e) at least one compound represented by the following general formula (I),

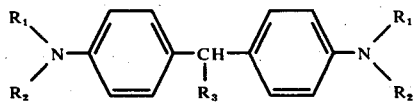

(I)

wherein $R_1$ and $R_2$ each is an alkyl group or an aralkyl group and $R_3$ is a hydrogen atom, an alkyl group, a chloroanilino group, a benzyloxy group, a 2-oxo-1-(N-phenylcarbamoyl)propyl group or a substituted phenyl group containing one or more of a chlorine atom, an alkyl group, an amino group, an alkylamino group and a dialkylamino group as substituents; the following general formula (II),

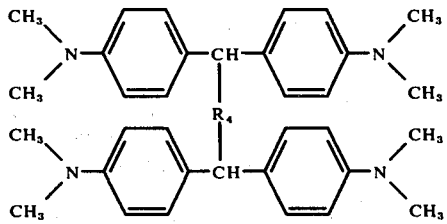

(II)

wherein $R_4$ is a

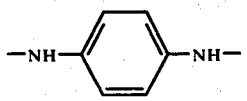

group, a

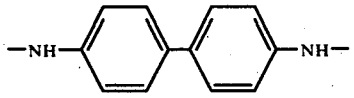

group or a $—NH(CH_2)_nNH—$ group where $n$ is an integer of 1 to 5; and the general formula (III)

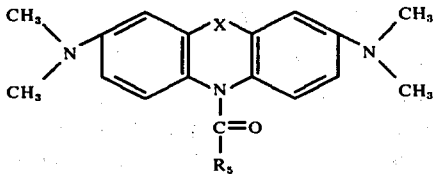

(III)

wherein $R_5$ is an aryl group, a 3-pyridyl group or a 2-thienyl group, and X is —S—, —O— or —NH—.

BRIEF DESCRIPTION OF THE DRAWING

The FIG. shows characteristic curves of a thermally developable photosensitive material of the invention and of a conventional thermally developable photosensitive material, directly after the preparation thereof and after the storage thereof.

DETAILED DESCRIPTION OF THE INVENTION

As described above $R_1$ and $R_2$ in general formula (I) represents an alkyl group such as an unsubstituted alkyl group or a substituted alkyl group such as a methanesulfonamidoethyl group, a carbamoylmethyl group, etc., or an aralkyl group.

In the general formula (I), an alkyl group having 1 to 5 carbon atoms such as a methyl group, an ethyl group, a propyl group, a butyl group or a pentyl group can be preferably used as the $R_1$, $R_2$ and $R_3$ substituents. Suitable substituted alkyl groups for $R_1$ and $R_2$ include a carbamoylmethyl group, a methoxyethyl group, an ethoxyethyl group, and aminoethyl group, an acetamidoethyl group, a methanesulfonamidoethyl group, etc. A preferred example of an aralkyl group for the $R_1$ and $R_2$ substituents is a benzyl group. Preferred examples of alkyl groups for the substituted phenyl group of $R_3$ are alkyl groups having 1 to 5 carbon atoms.

Suitably the alkylamino group and the dialkylamino group as substituents on the phenyl group of $R_3$ contain 1 to about 5 carbon atoms in the alkyl moiety or moieties thereof.

In the general formula (III), preferred examples of aryl groups for the $R_5$ substituent are a phenyl group, a naphthyl group, a chlorophenyl group and a nitrophenyl group.

Typical examples of the compounds represented by the general formulae (I) to (III) are shown in the Tables 1, 2 and 3.

Table 1

(Typical Examples of Compounds Represented by the General Formula (I)

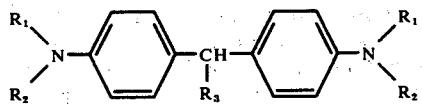

(I)

| Compound No. | R 1 | R 2 | R 3 |
|---|---|---|---|
| 1 | $—CH_3$ | $—CH_3$ | —H |
| 2 | $—CH_3$ | $—C_2H_5$ | —H |
| 3 | $—C_2H_5$ | $—C_2H_5$ | —H |
| 4 | $—C_2H_5$ | $—CH_2CH_2NHSO_2CH_3$ | —H |
| 5 | $—CH_3$ | $—CH_2C_6H_5$ | —H |
| 6 | $—CH_3$ | $—CH_3$ | $—C_6H_5$ |
| 7 | $—CH_3$ | $—CH_3$ | $—NHC_6H_4Cl$ |
| 8 | $—CH_3$ | $—C_2H_5$ | $—OCH_2C_6H_5$ |
| 9 | $—C_2H_5$ | $—C_2H_5$ | $—CH_3$ |
| 10 | $—C_2H_5$ | $—CH_2C_6H_5$ | —H |
| 11 | $—CH_3$ | $—CH_2C_6H_5$ | $—C_2H_4$ |
| 12 | $—CH_3$ | $—CH_3$ | $—CH_3$ |
| 13 | $—C_2H_5$ | $—C_2H_5$ | $—C_6H_5$ |
| 14 | $—CH_3$ | $—CH_2CH_2NHSO_2CH_3$ | —H |
| 15 | $—CH_2C_6H_5$ | $—CH_2C_6H_5$ | —H |
| 16 | $—CH_3$ | $—CH_3$ | 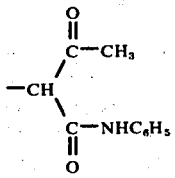 |
| 17 | $—CH_3$ | $—C_2H_5$ | 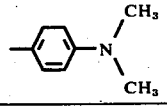 |

Table 2

(Typical Examples of Compounds Represented by the General Formula (II)

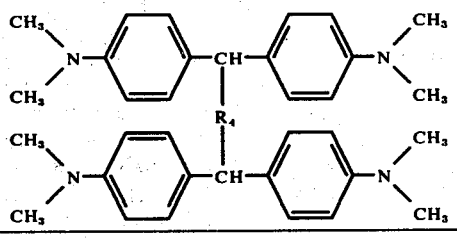

(II)

| Compound No. | R 4 |
|---|---|
| 18 | 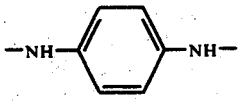 |
| 19 | 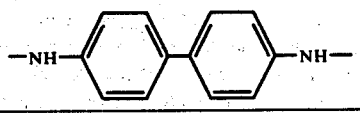 |

Table 3

(Typical Examples of Compounds Represented by the General Formula (III)

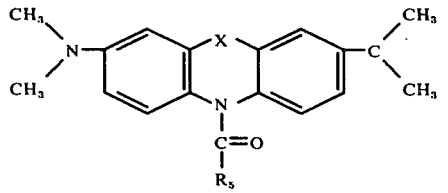

(III)

| Compound No. | R 5 | X |
|---|---|---|
| 20 | 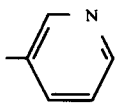 | —S— |
| 21 | 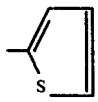 | —S— |
| 22 | 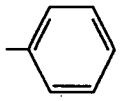 | —S— |
| 23 | 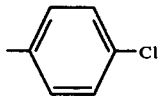 | —S— |
| 24 | 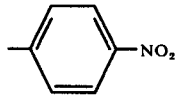 | —S— |
| 25 | 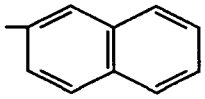 | —S— |
| 26 | 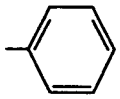 | —O— |
| 27 | 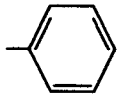 | —NH— |

The compounds employed as the component (e) in the invention can be used individually or in combination. These stabilizers can be used in combination with an acid stabilizer as disclosed in Japanese Patent Application 37,965/73.

Typical examples of acid stabilizers include benzene sulfonic acid, p-toluene sulfonic acid, tetrabromophthalic acid and tetrabromophthalic acid anhydride.

The amount of the component (e) generally used ranges from about 0.0001 to 0.1 mol, preferably about 0.005 to 0.01 mol, per mol of the organic silver salt component (a).

Examples of suitable organic silver salts as component (a) in the invention are a silver salt of an organic compound having a carboxyl group, e.g. a silver aliphatic carboxylate or a silver aromatic carboxylate or a silver salt of an organic compound having an imino group or a mercapto group. These silver salts are comparatively stable to light, and can form silver images by an oxidation-reduction reaction when the salts are exposed and heated under the catalytic action of the silver halide.

Typical examples of the organic silver salts are as follows;

1. Aliphatic carboxylic acids:

Silver caprate, silver laurate, silver myristate, silver palmitate, silver stearate, silver behenate, silver maleate, silver fumarate, silver sebacate, silver tartarate, silver adipate, silver linolate, etc.

2. Aromatic carboxylic acids:

Silver benzoate, silver 3,5-dihydroxybenzoate, silver o-methylbenzoate, silver m-methylbenzoate, silver p-methylbenzoate, silver 2,4-dichlorobenzoate, silver gallate, silver tannate, silver phthalate, silver terephthalate, silver salicylate, etc.

3. Silver salts of organic compounds having an imino group:

Silver saccharin, silver benzotriazole, silver phthalazinone, silver salt of 4-hydroxy-6-methyl-1,3,3*a*, 7-tetrazaindene, etc.

4. Silver salts of organic compounds having a mercapto group:

Silver salt of 3-mercapto-4-phenyl-1,2,4-triazole, etc.

As the reducing agent employed as the component (c), an organic reducing agent can be used which has sufficient reducing power to reduce the organic silver salt (a) to form silver images by the catalytic action of the silver halide in the exposed portions under heating.

These reducing agents (c) are generally dependent upon the specific organic silver salt component (a) with which they are used and are suitably selected from the following types of compounds 1. Monohydroxybenzenes
2. Dihydroxybiphenyls
3. Polyhydroxybenzenes
4. Naphthols, naphthylamines and aminonaphthols
5. Hydroxybinaphthyls
6. Aminophenols
7. p-Phenylenediamines
8. Alkylenebisphenols
9. Ascorbic acid and derivatives thereof
10. Pyrazolidones Typical specific examples of reducing agents are as follows;

1. Monohydroxybenzenes:

p-Phenylphenol, o-phenylphenol, p-ethylphenol, p-t-butylphenol, p-sec-butylphenol, p-t-amylphenol, p-methoxyphenol, p-ethoxyphenol, p-cresol, 2,6-di-t-butyl-p-cresol, 2,4-xylenol, 3,4-xylenol, 2,6-xylenol, 3,4-xylenol, p-acetylphenol, 1,4-dimethoxyphenol, 2,6-dimethoxyphenol, hydroquinone mono-n-hexyl ether, hydroquinone monobenzyl ether, chlorothymol, etc.

2. Dihydroxybiphenyls:

3,3′,5,5′-Tetra-t-butyl-4,4′ dihydroxybenzene, etc.

3. Polyhydroxybenzenes:

Hydroquinone, methylhydroquinone, t-butylhydroquinone, 2,5-dimethylhydroquinone, 2,6-dimethylhydroquinone, t-octylhydroquinone, phenylhydroquinone, methoxyhydroquinone, ethoxyhydroquinone, chlorohydroquinone, bromohydroquinone, hydroquinone monosulfonate, catechol, 3-cyclohexylcatechol, resorcinol, methyl gallate, n-propyl gallate, etc.

4. Naphthols, naphthylamines and aminonaphthols:

α-Naphthol, β-naphthol, 1-hydroxy-4-methoxynaphthalene, 1-hydroxy-4-ethoxynaphthalene, 1,4-dihydroxynaphthalene, 1,5-dihydroxynaphthalene, 1-hydroxy-2-phenyl-4-methoxynaphthalene, 9-hydroxy- 2-methyl-4-methoxynaphthalene, 1-amino-2-naphthol-6-sulfonic acid (potassium salt), 1-hydroxy-4-aminonaphthalene, 1-naphthylamine-7-sulfonate, etc.

5. Hydroxybinaphthyls:

1,1'-Dihydroxy-2,2'-binaphthyl, 4,4'-dimethoxy-1,1'-dihydroxy-2,2'-binaphthyl, 6,6'-dibromo-2,2'-dihydroxy-1,1'-binaphthyl, 6,6'-dinitro-2,2'-dihydroxy-1,1'-binaphthyl, bis(2-hydroxy-1-naphthyl)methane, etc.

6. Aminophenols:

p-Aminophenol, o-aminophenol, 2,4-diaminophenol, N-methyl-p-aminophenol, 2-methoxy-4-aminophenol, 2-β-hydroxy-ethyl-4-aminophenol, etc.

7. p-Phenylenediamines:

N,N'-Diethyl-p-phenylenediamine, N,N'-dibenzylidene-p-phenylenediamine, etc.

8. Alkylenebisphenols:

1,1-bis-(2-Hydroxy-3-t-butyl-5-methylphenyl)methane, 1,1-bis-(2-hydroxy-3,5-dimethylphenyl)-3,5,5-trimethylhexane, 1,1-bis-(2-hydroxy-3,5-di-t-butylphenyl)-2-methylpropane, 2,2-bis-(4-hydroxy-3-methylphenyl)propane, 4,4-bis-(4-hydroxy-3-methylphenyl)heptane, 2,2-bis-(4-hydroxy-3-isopropylphenyl)-propane, 2,2-bis-(4-hydroxy-3-phenylphenyl)-propane, 1,1-bis-(4-hydroxy-3-methylphenyl)cyclohexane, 2,2-bis-(4-hydroxy-3,5-dimethylphenyl)-propane, 2,2-bis-(4-hydroxy-3-t-butyl-5-methylphenyl)propane, 3,3-bis-(4-hydroxy-3-t-dodecylphenyl)-hexane, (4,4'-dihydroxy-3-methyldiphenyl)-2,2-propane, (4,4'-dihydroxy-3-t-octyldiphenyl)-2,2-propane, (4,4'-dihydroxy-3-t-butyldiphenyl)-4-methyl-2,2-pentane, (4,4'-dihydroxy-3-methyl-5-t-butyldiphenyl)-2,2-propane, 2,2-bis-(4-hydroxyphenyl)propane (4,4'-dihydroxy-3,3',5-trimethyldiphenyl)-3,3-pentane, N-(4-hydroxyphenyl)salicylamide, 2,2-bis-(3,5-dibromo-4-hydroxyphenyl)propane, bis(3-methyl-4-hydroxy-5-t-butylphenyl)sulfide, etc.

9. Ascorbic acids and derivatives thereof:

l-Ascorbic acid, monoesters such as the ethyl ester of l-ascorbic acid, diesters such as the diethyl ester of l-ascorbic acid, etc.

10. Pyrazolidones:

1-Phenyl-3-pyrazolidone, 4-methyl-4-hydroxymethyl-1-phenyl-3-pyrazolidone, etc.

These reducing agents can be used above or in combination. The reducing agent depends on the reducibility of the organic silver salt (c). For example, ascorbic acids having a stronger reducing ability are preferred for difficulty reducible silver salts such as silver benzotriazole. Further, as the number of carbon atoms of the of the silver salt of higher fatty acids increases, reducing agents having a stronger reducing ability must be selected. While a reducing agent having a comparatively weak reducing ability such as p-phenylphenol is suitable for silver laurate, a reducing agent having a stronger reducing ability such as 1,1'-bis-(2-hydroxy-3-t-butyl-5-methylphenyl)methane is suitable for silver behenate.

The amount of the reducing agent (c) can not be specified unequivocally because the amount is determined by oxidation-reduction combination of the components (a) and (b). Preferably, the amount of the reducing agent (c) is about 0.1 to 5 mol per mol of the organic silver salt (a).

A catalytic amount of a silver halide (b) is employed in the invention and suitable examples are silver chloride, silver bromide, silver iodobromide, silver chloroiodobromide, silver chlorobromide, silver iodide or a mixture thereof. These photosensitive silver halides can be coarse grain or fine grain, but preferably are very fine grain. A suitable grain size for the silver halide is about 0.01 to about 10 microns, preferably about 0.1 to about 5 microns in diameter. The silver halide emulsion can be prepared using well-known methods, for example, a single-jet process, a double-jet process, etc. The silver halide emulsion includes Lippman type emulsions, ammonical emulsions, thiocyanate or thioether ripened emulsions and the emulsion disclosed in U.S. Pat. Nos. 2,222,264, 3,320,069 and 3,271,157.

The silver halide emulsion in the invention can be sensitized with a chemical sensitizer such as a reducing agent, a sulfur or selenium compound, a gold, platinum or palladium compound. Suitable sensitation methods are disclosed in U.S. Pat. Nos. 2,623,499, 2,399,083, 3,297,447 and 3,297,446.

As described above, the catalytic amount of the photosensitive silver halide can be previously prepared and then added to a photosensitive layer of thermally developable material. More preferably, the catalytic amount of the silver halide can be prepared by forming the organic silver salt (a) in the presence of a halide, or by reacting an organic silver salt (a) with a halide. For example, in such a method, an aqueous solution of a halide such as ammonium bromide is added to a polymer dispersion of an organic silver salt such as silver laurate. It is apparent from the change in the X-ray diffraction pattern that silver bromide is prepared by reacting a part of silver laurate with ammonium bromide.

Suitable examples of halides which can be used in the invention are inorganic halides, for example, those represented by $MX_n$ in which M is a hydrogen atom, an ammonium group or a metal atom, X is a halogen atom, and $n$ is 1 when M is a hydrogen atom or an ammonium group and when M is a metal atom, $n$ is the valence of the metal atom.

Typical examples of the halides include hydrogen halides, ammonium halides, the halides of metals such as strontium, cadmium, zinc, tin, chromium, sodium, barium, iron, cesium, lanthanum, copper, calcium, nickel, magnesium, potassium, aluminum, antimony, gold, cobalt, mercury, lead, beryllium, lithium, manganese, gallium, indium, rhodium, ruthenium, palladium, iridium, platinum, thallium, bismuth, etc. As the halides, a chloride, bromide, iodide and a mixture thereof can be used.

Further, examples of halides, which can be used, are organic halides such as triphenylmethyl chloride, triphenylmethyl bromide, 2-bromo-2-methylpropane, 2-bromobutyric acid, 2-bromoethanol or di-chlorobenzophenone, a halogenated hydrocarbon such as iodoform, bromoform or carbon tetrabromide, a halogen metal complex, an onium halide, and an N-halocompound.

The amount of photosensitive silver halide or compounds capable of forming the silver halide preferably ranges from about 0.001 to 0.5 mol per mol of the organic silver salt (a). If the amount is less than about 0.001 mol, the sensitivity of the thermally developable material is reduced, and if the amount is greater than about 0.5 mol, the amount of silver halide to be generated is increased, whereby unexposed portions thereof are often blackened when allowed to stand under normal room illumination because silver halide has the property that it is blackened under room light, and as the result thereof, the contrast between the image portions and the non-image portions is reduced.

The coating compositions for the heat developable light-sensitive material of the invention includes a binder (d), which is suitably hydrophobic but may be hydrophilic. The binder is transparent or semi-transparent, and can be selected from natural substances such as gelatin, gelatin derivatives, cellulose derivatives, etc., and synthetic polymers such a polyvinyl compounds, acrylamide polymers, etc. Other synthetic polymers include a latex such as a dispersion of a vinyl compound.

These binders include polysaccharides such as dextran, natural rubber such as gum arabic, polyacrylamide, polyvinyl acetate benzyl cellulose, cellulose acetate, cellulose propionate cellulose acetate phthalate, etc.

Typical binders, also include polyvinyl butyral, cellulose acetate butyrate, polymethylmethacrylate, polyvinyl pyrrolidone, ethyl cellulose, polystyrene, polyvinyl chloride, chlorinated rubber, polyisobutylene, butadiene-styrene copolymers, vinyl chloride-vinyl acetate copolymers, vinyl chloride-vinyl acetate-maleic acid copolymers, polyvinyl alcohol, etc. Various suitable polymers for the binder are disclosed in U.S. Pat. Nos. 3,142,586, 3,193,386, 3,062,674, 3,220,844, 3,287,289 and 3,411,911, etc. Among these polymers and resins, polyvinyl butyral, polyvinyl acetate, ethy cellulose, polymethylmethacrylate, and cellulose acetate butyrate are preferably employed. The amount of the binder (d) is about 1/5 to 10 parts by weight, preferably ¼ to 4 parts by weight, based on the weight of the organic silver salt (a).

In the invention, all kinds of supports can be utilized. Typical examples of suitable supports are cellulose nitrate films, cellulose ester films, poly(vinyl acetal) films, polystyrene films, polyethylene terephthalate films, polycarbonate films, and other resineous substances, glass, paper, metal, etc.

The amount of the silver coated on the support generally ranges from about 0.2 to 3 grams per square mether, preferably 0.4 to 2 grams per square meter. If the amount is less than about 0.2 grams per square meter, sufficient image density can not be obtained, and if the amount is greater than 3 grams per square meter, the cost is increased while photographic properties are not thereby improved additionally.

On the thermally developable photosensitive material of the invention, an antistatic layer or an electroconductive layer can be provided if desired. The photosensitive material of the invention can include an antihalation substance and dye.

If desired, an overcoat polymer layer can be employed and can include kaolin, starch, titanium dioxide, zinc oxide or silica. These matting agents can be incorporated into the photosensitive layer. Further, a fluorescent brightening agent such as a stilbene, a triazine, an oxazole, a cumarine, etc. can be similarly incorporated in the photosensitive layer.

In order to increase the transparency of the photosensitive layer, to increase the image density, to improve the shelf life or to enhance the heat resistance of the photosensitive layer, an overcoat polymer layer can be applied to the photosensitive layer. A suitable thickness of the polymer layer ranges from about 1 to 20 microns. If the thickness is less than about 1 micron, the above results can not be obtained, and the thickness is greater than about 20 microns, the costs therefor are increased unaccompanied by any further improvement in results. Suitable polymers therefor are colorless and soluble in a solvent, and are heat-resistant. For example, polyvinyl chloride, polyvinyl acetate, vinyl chloride-vinyl acetate copolymers (preferably, not less than about 50 mol% of vinyl chloride), polyvinyl butyral, polystyrene, polymethyl methacrylate, benzyl cellulose, ethyl cellulose, cellulose acetate butyrate, cellulose diacetate, cellulose triacetate, polyvinylidene chloride, polypropylene chloride, polyvinyl pyrrolidone, cellulose propionate, polyvinyl formal, cellulose acetate phthalate, polycarbonate, cellulose acetate propionate, etc. are useful. Other types of polymers which can be used include gelatin, gelatin derivative such as phthalated gelatin, acrylamide polymers, polyisobutyrene, butadiene-styrene copolymers (optional monomer ratio) and polyvinyl alcohol.

Preferred polymers have a heat resistance of higher than about 115° F and refractive index of greater than about 1.45.

The thermally developable photosensitive layer and an overcoat polymer layer in the invention can be coated using various conventional methods, for example, a dip coating method, an air knife coating method, a curtain coating method or a hopper type extrusion coating method as disclosed in U.S. Pat. No. 2,681,294. Optionally, two or more layers can be coated, simultaneously.

The thermally developable photosensitive material which is composed of the components (a), (b), (c), (d) and (e) can further contain a toning agent, a heat fog-preventing agent or a stabilizer.

Suitable toning agents include phthalazinone, N-hydroxyphthalimide, phthalimide, potassium phthalimide, etc. A phthalimide type toning agent is disclosed in British Pat. No. 1,342,523. By incorporating the toning agent into the thermally developable photosensitive material, pure black tone images can be obtained. Heat fog-preventing agents include an N-halosuccinimide such as N-bromosuccinimide, or an N-halo acetamide such as N-bromoacetamide. Suitable stabilizers include benzene sulfonic acid, p-toluene sulfonic acid, tetrabromophthalic acid and tetrabromophthalic acid anhydride.

Some kinds of spectral sensitizers useful for silver halide emulsions can be advantageously applied to the thermally developable photosensitive material of the invention to increase the photosensitivity. That is, the photosensitive material of the invention can be spectrally sensitized by adding an organic solvent solution of a spectral sensitizer or a dispersion thereof. Useful spectral sensitizers are cyanine dyes, merocyanine dyes, rhodacyanine dyes, styryl dyes, erythrosine, eosine, fluorescein and other acidic dyes. The amount of the dye generally is about $10^{-6}$ to about $10^{-2}$ mol per mol of component (a). Suitable examples of spectral sensitizers which can be used are disclosed in, e.g., U.S. Pat. Nos. 3,719,495, 3,761,279, 3,615,432 and German Patent Publication No. 2,140,462.

The above discribed coating composition for a thermally developable photosensitive material is then coated on a support to provide the photo sensitive material of the invention.

The thermally developable photosensitive material of the invention can be exposed e.g., for about 0.01 to 60 seconds, preferably 0.1 to 30 seconds, to light from a xenon lamp, a tungsten lamp, a mercury lamp or another light source to form latent images which are converted to images by thermal development. Accordingly, another embodiment of the invention includes a thermal development method which comprises heating the exposed material to about 90 to 180° C, preferably 100° to 160° C, until desirable images appear.

The development time is suitably about 0.1 to about 100 seconds. The development temperature can be varied outside this range by appropriately prolonging or shortening the developing time. Stable images can be usually obtained within 1 to 60 seconds. The heating operation can be carried out using various methods. For example, the photosensitive material can be contacted with a heated plate or drum, of if desired, can be passed through a heated zone or can be heated by high frequency.

The stabilizer used in the invention improves the shelf life of the thermally developable photosensitive material acting as an oxidation inhibitor for the reducing agent, particularly for a silver fatty acid.

The invention will be illustrated in greater detail by reference to the following Examples. Unless otherwise indicated all parts percents ratios and the like are by weight.

EXAMPLE 1

200 ml. of toluene in which 12 g. of lauric acid was dissolved was mixed with 100 ml. of an aqueous solution containing 1.9 g. of sodium hydroxide, and then emulsified by means of a homomixer. To the emulsion, 50 ml. of 0.4% aqueous solution of hydrobromic acid was added and emulsified. To the emulsion, 50 ml. of an aqueous solution containing 8.5 g. of silver nitrate was added to produce silver laurate and silver bromide, simultaneously. After removing the water layer, the toluene layer was dispersed in 120 g. of a 15% isopropanol solution of polyvinyl butyral to obtain a dispersion (hereinafter, referred to "silver salt polymer dispersion").

To 20 g. of the silver salt polymer dispersion, the following components were added and then coated on a paper (Art Paper) in the amount of silver of 0.6 g. to provide a thermally developable photosensitive Material (A).

| | |
|---|---|
| 2',7'-Dichlorofluorescein (0.025 wt% methanol solution) | 5 ml. |
| 10-Benzoyl-3,7-bis(dimethylamino)phenothiazine (1.0 wt% benzene solution; Compound 22) | 0.1 ml. |
| Phthalazinone (1.25 wt% methanol solution) | 4 ml. |
| Chlorothymol (15 wt% methanol solution) | 5 ml. |

For comparison, the same procedure as described above was repeated to obtain a thermally developable photosensitive Material (B) except that Compound 22 was not employed.

On the photosensitive layer of each photosensitive Material (A) and (B), a 15 wt% tetrahydrofuran solution of a vinyl chloride-vinyl acetate copolymer (95 wt% vinyl chloride and 5 wt% vinyl acetate) was coated on a support in a dry thickness of 10 microns.

Each photosensitive Material (A) and (B) was exposed through a step wedge to light from a tungsten lamp of 500,000 lux-second, and heated to 120° C for 40 seconds, whereby images in a step wedge form were obtained. The photographic properties of the images in Materials (A) and (B) directly after development (hereinafter, referred to "Fresh") substantially were not different from each other.

On the other hand, after storing the photosensitive Materials (A) and (B) for 5 months in the dark, they were exposed and developed under heating similar to the above steps to obtain images in the step wedge form, of which characteristic curves are shown in the FIG. In the FIG., the abscissa shows the relative exposure amount (log. E), and the ordinate shows the photographic density which is measured by converting the blackened reflection density to optical density.

From the FIG. the relative sensitivity of each of Materials (A) and (B) was obtained which is shown in the following Table.

| | | Dark Storage | |
|---|---|---|---|
| | Fresh | Material (A) | Material (B) |
| Relative Sensitivity | 100 | 300 | 2 |

In the above table, the relative sensitivity is shown by representing the sensitivity on development of the sample immediately after production (Fresh) as 100. The sensitivity is the reciprocal of the exposure amount necessary for providing a blackened reflection density of fog 0.1. The fog is the reflection density generated by heating the unexposed portions of the material.

The photosensitive Material (A) of the invention shows that heat fog is not increased after the lapse of time compared with the development of the fresh sample, and that the maximum density is increased.

Where p-phenylphenol was used instead of chlorothymol as a reducing agent, heat fog was reduced while the relative sensitivity was not increased. That is, p-phenylphenol has a stabilizing action similar to chlorothymol.

Where Compound 1, 4 or 23 is used instead of Compound 22, similar results were obtained.

EXAMPLE 2

To 20 g. of a polymer dispersion as described in Example 1, the following components were added and then coated on a support in a silver amount of 1.0 g/m$^2$ to provide a thermally developable photosensitive Material (A). For comparison, the same procedure as described above except that a stabilizer was not employed was repeated to provide a thermally developable photosensitive Material (B).

| | |
|---|---|
| N-Bromoacetamide (25 wt% methanol solution) | 1 ml. |
| Tetrachlorotetrabromofluorescein (0.025 wt% methanol solution) | 3 ml. |
| 4,4'-Tetraethyldiaminodiphenylmethane (Compound 4, 1 wt% acetone solution) | 0.1 ml. |
| Phthalazinone (2.5 wt% methanol solution) | 1 ml. |
| Chlorothymol (15 wt% methanol solution) | 5 ml. |
| Tetrabromophthalic Acid (0.6 wt% methanol solution) | 4 ml. |

The thus prepared Materials (A) and (B) were processed in the same manner as in Example 1 to obtain images in a step wedge form. No difference was observed between Material (A) and Material (B) on development immediately after production.

The relative sensitivity of each of Material (A) and Material (B) after standing in the dark is shown in the following table.

| | Fresh | Dark Storage | |
|---|---|---|---|
| | | Material (A) | Material (B) |
| Relative Sensitivity | 100 | 80 | 10 |

Where Compound 5, 14, 18 or 20 was used instead of Compound 4, the same results were obtained.

EXAMPLE 3

In 100 ml. of toluene, 3.4 g. of behenic acid was dissolved at 60° C. While maintaining the temperature at 60° C, 100 ml. of an aqueous solution of dilute nitric acid having a pH of 2.0 was mixed with the solution under stirring. To the mixture, 100 ml. of an aqueous solution of silver ammonium complex and 50 ml. of an aqueous solution containing 0.047 g. of ammonium bromide and 0.001 g. of ammonium iodide were simultaneously added. The aqueous solution of silver ammonium complex solution was prepared by adding an aqueous ammonia solution to about 80 ml. of an aqueous solution containing 1.7 g. of silver nitrate and then adding water to make the total volume 100 ml. The reaction product was allowed to stand for 20 minutes and an aqueous layer separated from the toluene layer containing silver behenate and silver iodo-bromide.

After removing the water layer, 400 ml. of water was added and then decanted off. The washing was repeated three times, and 400 ml. of toluene was added and then centrifugally separated to obtain 4 g. of silver behenate criptals in the form of spindles having a size of 1 micron × 0.05 micron.

To 20 ml. of isopropyl alcohol solution containing 2 g. of polyvinyl butyral, 2.5 g. of silver behenate was added and kneaded for one hour using a ball mill to provide a polymer dispersion. To 20 ml. of the thus prepared polymer dispersion, the following components were added to prepare a coating composition which was then coated on a polyethylene terephthalate film in a silver amount of 1.5 g./m$^2$ to provide a thermally developable photosensitive Material (A).

For comparison, the same procedure as above was repeated to provide a thermally developable photosensitive Material (B) except that a stabilizer was not employed.

| | |
|---|---|
| Ammonium Bromide (2.5 wt% methanol solution) | 1 ml. |
| Benzoxazolilidene Rhodanine (0.025 wt% chloroform solution) | 1 ml. |
| 10-(4'-Chlorobenzoyl)-3,7-bis(dimethylamino) phenothiazine (Compound 23, 1.0 wt% benzene solution) | 0.1 ml. |
| Phthalazinone (3.0 wt% methanol solution) | 5 ml. |
| 2,2'-Methylenebis(6-t-butyl-4-methylphenol) (25 wt% 2-methoxyethanol solution) | 3 ml. |
| Behenic Acid (3 wt% 2-methoxyethanol solution) | 5 ml. |

The thus prepared thermally developable photosensitive Materials (A) and (B) were tested in the same manner as in Example 1 to obtain images in a step wedge form. There was no difference between photographic properties of Materials (A) and (B) upon development immediately after production. The relative sensitivity after standing in the dark are shown below.

| | Fresh | Dark Storage | |
|---|---|---|---|
| | | Material (A) | Material (B) |
| Relative Sensitivity | 100 | 80 | 30 |

Where Compound 1, 3, 6, 12, 16 or 21 was used instead of Compound 23, similar results were obtained.

While the invention has been described in detail and with reference to specific embodiments thereof, it will be apparent to one skilled in the art that various changes and modifications can be made therein without departing from the spirit and scope thereof.

What is claimed is:

1. A thermally developable photosensitive material comprising a support having thereon in one or more layers, (a) an organic silver salt, (b) a catalytic amount of a photosensitive silver halide or a compound capable of forming photosensitive silver halide, (c) a reducing agent, (d) a binder and (e) at least one compound represented by the following general formula (I),

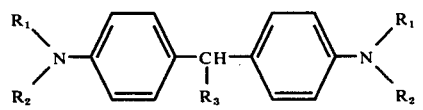

(I)

wherein $R_1$ and $R_2$ each is an alkyl group or an aralkyl group; and $R_3$ is a hydrogen atom, an alkyl group, a chloroanilino group, a benzyloxy group, a 2-oxo-1-(N-phenylcarbamoyl)propyl group, a phenyl group, or a substituted phenyl group having one or more of a chlorine atom, an alkyl grup, an amino group, an alkylamino group and a dialkylamino group as substituents; the following general formula (II),

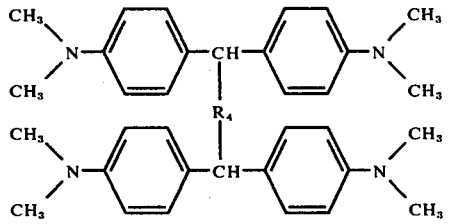

(II)

wherein $R_4$ is a

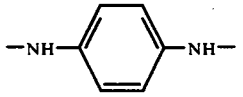

group, a

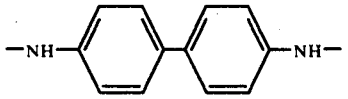

group or a —NH($CH_2$)$_n$—NH— group, and $n$ is an integer of 1 to 5; or the following general formula (III)

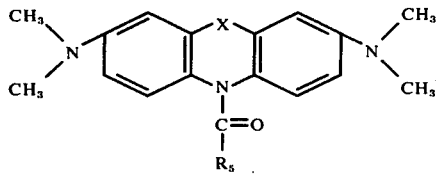

wherein $R_5$ is an aryl group, a 3-pyridyl group or a 2-thienyl group, and X is —S—, —O— or —NH—.

2. The thermally developable photosensitive material of claim 1 wherein said alkyl group for $R_1$ and $R_2$ is an unsubstituted alkyl group or a substituted alkyl group having as substituents a carbamoyl group, a methoxy group, an ethoxy group, an amino group, an acetamido group or a methanesulfonamido group; wherein the alkyl group for $R_1$, $R_2$ and $R_3$ has from 1 to 5 carbon atoms; wherein said aralkyl group for $R_1$ and $R_2$ is a benzyl group, wherein said alkyl group substituent for said substituted phenyl group is an alkyl group having 1 to 5 to carbon atoms, and wherein said aryl group for $R_5$ is a phenyl group, a naphthyl group, a chlorophenyl group or a nitrophenyl group.

3. The thermally developable photosensitive material of claim 1, wherein said organic silver salt (a) is a silver salt of a compound containing a carboxyl group, an imino group or a mercapto group.

4. The thermally developable photosensitive material of claim 3, wherein said organic silver salt (a) is a silver aliphatic carboxylate or a silver aromatic carboxylate.

5. The thermally developable photosensitive material of claim 4, wherein said silver aliphatic carboxylate is silver caprate, silver laurate, silver myristate, silver palmitate, silver stearate, silver behenate, silver maleate, silver fumarate, silver sebacate, silver tartarate, silver adipate, or silver linolate and said silver aromatic carboxylate is silver benzoate, silver 3,5-dihydroxybenzoate, silver o-methylbenzoate, silver m-methylbenzoate, silver p-methylbenzoate, silver 2,4-dichlorobenzoate, silver gallate, silver tannate, silver phthalate, silver terephthalate, or silver salicylate.

6. The thermally developable photosensitive material of claim 1, wherein said photosensitive silver halide is silver chloride, silver bromide, silver iodobromide, silver chloroiodobromide, silver chlorobromide, silver iodide or a mixture thereof.

7. The thermally developable photosensitive material of claim 1, wherein said compound capable of forming photosensitive silver halide is an inorganic halide having the formula $MX_n$ in which M is a hydrogen atom, an ammonium group or a metal atom, X is a halogen atom, and $n$ is 1 when M is a hydrogen atom or an ammonium group and $n$ is the valence of the metal atom when M is a metal atom; an organic halide selected from the group consisting of triphenylmethyl chloride, triphenylmethyl bromide, 2-bromo-2-methy-methane, 2-bromobutyric acid, 2-bromoethanol, dichlorobenzophenone, iodoform, bromoform or carbon tetrabromide; a halogen metal complex; an onium halide; a halogenated hydrocarbon; or an N-halocompound.

8. The thermally developable photosensitive material of claim 1, wherein said inorganic halide having the general formula is a hydrogen halide or an ammonium halide.

9. The thermally developable photosensitive material of claim 1, wherein said reducing agent (c) is a monohydroxybenzene, a dihydroxybiphenyl, a polyhydroxybenzene, a naphthol, a naphthylamine, an aminonaphthol, a hydroxybinaphthyl, an aminophenol, a p-phenylenediamine, an alkylenebisphenol, an ascorbic acid or a derivative thereof, or a pyrazolidone.

10. The thermally developable photosensitive material of claim 1, wherein said component (b) is present in an amount of from about 0.001 to 0.5 mol per mole of the organic silver salt (a), the reducing agent (c) is present in an amount of about 0.1 to 5 moles per mole of the organic silver salt (a), the binder (d) is present in an amount of from about 1/5 to 10 parts by weight per part by weight of the organic silver salt (a) and component (e) is present in an amount of from about 0.0001 to 0.1 mole per mole of the organic silver salt (a).

* * * * *